US011643232B2

(12) United States Patent
Mårstedt et al.

(10) Patent No.: US 11,643,232 B2
(45) Date of Patent: May 9, 2023

(54) BINDING MACHINE AND METHOD FOR TESTING THE STRENGTH OF A JOINT FORMED ON A CLOSED LOOP OF AN ELONGATED BINDING ELEMENT

(71) Applicant: SUND BIRSTA AB, Sundsvall (SE)

(72) Inventors: Peter Mårstedt, Stockholm (SE); Erik Danielsson, Sundsvall (SE); Ove Englund, Stockholm (SE)

(73) Assignee: Sund Birsta AB, Sundsvall (SE)

( * ) Notice: Subject to any disclaimer, the term of this patent is extended or adjusted under 35 U.S.C. 154(b) by 149 days.

(21) Appl. No.: 17/312,059

(22) PCT Filed: Nov. 7, 2019

(86) PCT No.: PCT/EP2019/080570
§ 371 (c)(1),
(2) Date: Jun. 9, 2021

(87) PCT Pub. No.: WO2020/126202
PCT Pub. Date: Jun. 25, 2020

(65) Prior Publication Data

US 2022/0024622 A1 Jan. 27, 2022

(30) Foreign Application Priority Data

Dec. 21, 2018 (EP) ..... 18215026

(51) Int. Cl.
*B65B 13/22* (2006.01)
*B65B 13/06* (2006.01)
(Continued)

(52) U.S. Cl.
CPC ..... *B65B 13/22* (2013.01); *B65B 13/06* (2013.01); *B65B 13/32* (2013.01); *B65B 57/00* (2013.01)

(58) Field of Classification Search
CPC ..... B65B 13/04; B65B 13/06; B65B 13/18; B65B 13/185; B65B 13/22; B65B 13/32; B65B 57/00; B65B 57/02
See application file for complete search history.

(56) References Cited

U.S. PATENT DOCUMENTS 3,439,606 A 4/1969 Bursik et al.
4,314,131 A 2/1982 Fryer
(Continued)

FOREIGN PATENT DOCUMENTS

JP H04-44922 A 2/1992

*Primary Examiner* — Jimmy T Nguyen
(74) *Attorney, Agent, or Firm* — Dilworth & Barrese, LLP

(57) ABSTRACT

A binding machine including a feeding and tensioning device for feeding a binding element in the form of a wire or strap around a space, and a joining device for forming a joint between a first binding element section at the leading end of the binding element and a second binding element section at the trailing end of a piece of the binding element arranged in a loop in or around the space to thereby form a closed loop of this piece of the binding element. The feeding and tensioning device is configured to exert a tensile force on the binding element in order to subject the joint to a tensile test. During this test, a gripping arrangement is configured to keep the first binding element section secured in fixed position by engagement with a part of the first binding element section located between the joint and the leading end of the binding element.

20 Claims, 9 Drawing Sheets

(51) Int. Cl.
*B65B 13/32* (2006.01)
*B65B 57/00* (2006.01)

(56) References Cited

U.S. PATENT DOCUMENTS

| | | | | |
|---|---|---|---|---|
| 5,442,899 | A * | 8/1995 | Shibazaki | B65B 13/04 53/589 |
| 2003/0061785 | A1* | 4/2003 | Sakaki | B65B 13/22 53/399 |
| 2005/0241270 | A1* | 11/2005 | Katsumata | B65B 13/22 53/64 |

* cited by examiner

BINDING MACHINE AND METHOD FOR TESTING THE STRENGTH OF A JOINT FORMED ON A CLOSED LOOP OF AN ELONGATED BINDING ELEMENT

FIELD OF THE INVENTION AND PRIOR ART

The present invention relates to a binding machine according to the description herein. The invention also relates to a method for forming a closed loop of an elongated binding element in the form of a wire or strap by means of a binding machine and testing the strength of a joint formed on said closed loop.

Automatic binding machines for applying a binding element in the form of a strap or wire in a loop around an object or a bundle of objects, drawing the binding element tightly around the object/bundle and thereafter joining two sections of the binding element in order to secure the binding element around the object/bundle are known in many different configurations. As an example, WO 2017/129679 A1 discloses a binding machine where a laser welding device is used for forming a joint between two sections at opposite ends of a piece of a binding element in the form of a wire or strap arranged in a loop around an object or a bundle of objects to thereby secure this piece of the binding element in a loop around the object or objects. As an alternative to laser welding, such a joint could be formed by any other suitable type of welding. When it comes to a binding element in the form of a metallic strap, it would also be possible to form the joint by punching locking seals and a securing seal in two mutually overlapping strap sections by means of punching members, for instance in the manner disclosed in EP 2 243 708 A1.

It is previously known from U.S. Pat. No. 4,314,131 A to test the strength of a welded butt joint formed on a loop of wire in a binding machine by gripping the wire on opposite sides of the joint by means of a stationary clamping member and a moveable clamping member and then moving the moveable clamping member away from the stationary clamping member in order to subject the joint to a tensile test.

SUMMARY OF THE INVENTION

The object of the present invention is to achieve a new and favourable manner of testing the strength of a joint formed in a binding machine on a loop of a binding element in the form of a wire or strap.

According to the invention, this object is achieved by means of a binding machine having the features defined herein.

The binding machine of the present invention comprises:

- a feeding and tensioning device for feeding an elongated binding element in the form of a wire or strap in a loop around a space configured for receiving one or more objects to be bound and subsequently retracting the binding element to draw it tightly around one or more objects received in said space;
- a gripping arrangement for gripping and locking a first binding element section at the leading end of the binding element after the feeding of the binding element in a loop around said space;
- a joining device for forming a joint between said first binding element section and an adjoining second binding element section at the trailing end of a piece of the binding element arranged in a loop in or around said space to thereby form a closed loop of this piece of the binding element; and
- an electronic control device configured to control the feeding and tensioning device to exert a tensile force on the binding element after the formation of said joint in order to subject the joint to a tensile test and thereby check the strength of the joint, wherein the gripping arrangement during said tensile test is configured to keep the first binding element section secured in fixed position by engagement with a part of the first binding element section located between said joint and the leading end of the binding element.

Thus, according to the present invention, a tensile test for testing the strength of the joint formed on the binding element is effected by means of the feeding and tensioning device of the binding machine in a simple and efficient manner. The possibility to subject the joint to an efficient tensile test by pulling the binding element under the effect of the feeding and tensioning device has been made possible by making the gripping arrangement keep the first binding element section secured in fixed position by engagement with a part of the first binding element section located between the joint and the leading end of the binding element. Hereby, the gripping of the binding element and the pulling thereof are effected on opposite sides of the joint, which implies that the joint will take up the entire or at least almost the entire tensile force exerted by the feeding and tensioning device during the tensile test.

Further advantageous features of the binding machine according to the present invention will appear from the description following below.

The invention also relates to a method having the features defined herein.

Further advantageous features of the method according to the present invention will appear from the description following below.

BRIEF DESCRIPTION OF THE DRAWINGS

With reference to the appended drawings, a specific description of preferred embodiments of the invention cited as examples follows below. In the drawings.

DETAILED DESCRIPTION OF EMBODIMENTS OF THE INVENTION

Figure 1:
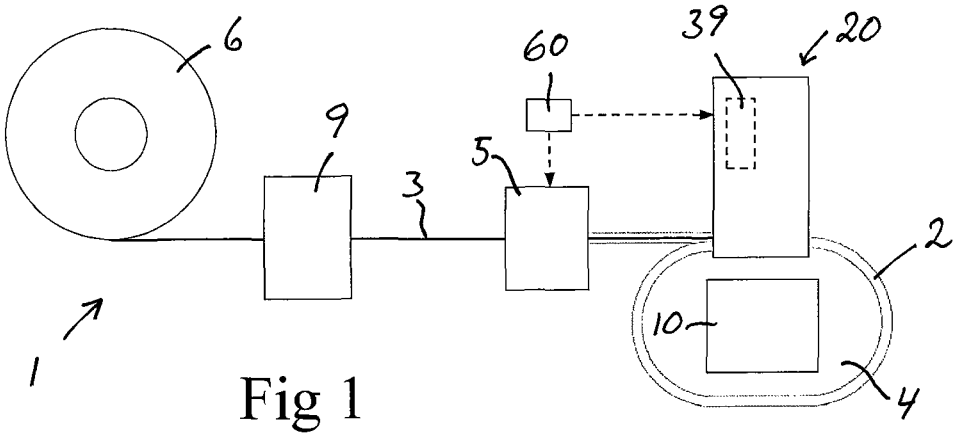
FIG. 1 is an outline diagram of a binding machine according to an embodiment of the present invention.

Some of the parts included in a binding machine 1 according to an embodiment of the present invention are very schematically illustrated in FIG. 1. The binding machine 1 comprises:

- a guide track 2 for guiding an elongated binding element 3 in the form of a wire or strap in a loop around a space 4 configured for receiving one or more objects 10 to be bound;
- a sealing unit 20 for securing the binding element 3 around said one or more objects 10;
- a feeding and tensioning device 5 for feeding the binding element 3 from a supply coil 6, through the sealing unit 20, into said guide track 2, along the guide track in a loop around said object receiving space 4 and then back into the sealing unit 20 and subsequently retracting the binding element 3 to draw it tightly around one or more objects 10 received in said space 4; and
- an accumulator 9 for temporarily accumulating a part of the binding element 3 when the binding element is retracted by the feeding and tensioning device 5 and then releasing the accumulated part of the binding element when the binding element thereafter is fed forwards by the feeding and tensioning device 5.

The guide track 2 may for instance have the form of a rail with a longitudinal opening facing said object receiving space 4. As an alternative, the binding element may also be fed in a loop around the object or objects to be bound without using any guide track. This may be accomplished by feeding the binding element through a bending device that is configured to bend the binding element in such a manner that it will move in free space, without contact with any guide track or the similar, in an essentially circular path around the object or objects 10 to be bound, wherein a funnel-shaped guiding element may be arranged at the end of said path in order to catch the leading end of the binding element and guide it into the sealing unit.

The object or objects 10 to be bound may be positioned in the object receiving space 4 before, during or after the feeding of the binding element 3 in a loop around this space 4.

As an alternative to the use of an accumulator 9, the slackening of the binding element 3 when the binding element is retracted by the feeding and tensioning device 5 may be taken up or avoided by rotating the supply coil 6 in a reversed direction.

Some of the parts included in the above-mentioned sealing unit 20 are very schematically illustrated in FIGS. 2*a*-2*j* and 3*a*-3*e*. The sealing unit 20 comprises a gripping arrangement 30 for gripping and locking a first binding element section 7*a* at the leading end of the binding element 3 after the feeding of the binding element in a loop around the object receiving space 4. The sealing unit 20 further comprises a joining device 40 for forming a joint 8 between said first binding element section 7*a* and an adjoining second binding element section 7*b* at the trailing end of a piece 3*a* of the binding element arranged in a loop in or around the object receiving space 4 to thereby form a closed loop 11 of this piece 3*a* of the binding element.

The binding machine 1 may have the form of a strapping machine, wherein the binding element 3 is a strap of metallic or plastic material. In this case, the above-mentioned joining device 40 may comprise punching members for punching locking seals and a securing seal at mutually overlapping ends of a piece of a binding element in the form of a metallic strap applied in a loop around said one or more objects 10. As an alternative, the joining device 40 of the strapping machine may be a welding device, for instance a laser welding device, which is configured to form the joint 8 between the above-mentioned first and second binding element sections 7*a*, 7*b* as a lap joint with the second binding element section 7*b* overlapping the first binding element section 7*a*.

The binding machine 1 may also have the form of a wire binding machine, wherein the binding element 3 is a wire of metallic material. In this case, the above-mentioned joining device 40 is a welding device, for instance a laser welding device, which is configured to form a welded joint between the above-mentioned first and second binding element sections 7*a*, 7*b*. In this case, the joining device 40 is configured to form the joint as a longitudinal welded joint at the interface between the first and second binding element sections 7*a*, 7*b*, wherein the second binding element section 7*b* is located in parallel with and at the side of the first binding element section 7*a*.

In the illustrated embodiment, the binding machine 1 is a strapping machine provided with a joining device 40 in the form of a laser welding device provided with a laser welding head 42, wherein the joint 8 between the first and second binding element sections 7*a*, 7*b* is formed by means of a laser beam 43 (see FIGS. 2*g* and 3*d*) emitted from the laser welding head. The laser welding device 40 comprises means of conventional type for directing and focusing the emitted laser beam 43 onto a desired target area.

The feeding and tensioning device 5 may be of any desired type suitable for use in a binding machine of the type here in question. The feeding and tensioning device 5 is for instance of the type described in closer detail in EP 3 398 866 A1.

In the illustrated embodiment, the feeding and tensioning device 5 comprises two rotatable feeding rollers 5*a*, 5*b* for feeding and retracting the binding element 3 and tensioning members in the form of two rotatable tensioning rollers 5*c*, 5*d* for tensioning the binding element 3. Under the effect of the feeding rollers 5*a*, 5*b*, the binding element 3 is first fed forwards in a loop around the object receiving space 4 and thereafter retracted in order to be pulled into contact with one or more objects 10 to be bound, wherein the binding element 3 is subjected to an initial stretching when being retracted by the feeding rollers 5*a*, 5*b*. Thereafter, the binding element 3 is subjected to a final stretching under the effect of the tensioning rollers 5*c*, 5*d* before being secured around said one or more objects 10.

The feeding rollers 5*a*, 5*b* are located opposite each other and configured to be in contact with opposite sides of a part of the binding element 3 received in the nip between the feeding rollers. At least one of the feeding rollers 5*a*, 5*b* is rotatably driven by an actuator (not shown) in the form of a reversible drive motor in order to move the binding element 3 in its longitudinal direction. The drive motor is configured to rotate the driven feeding roller at high speed and low torque. The drive motor is preferably an electric motor, but it could as an alternative be a hydraulic or pneumatic motor.

Also the tensioning rollers 5*c*, 5*d* are located opposite each other and configured to be in contact with opposite sides of a part of the binding element 3 received in the nip between the tensioning rollers. At least one of the tensioning rollers 5*c*, 5*d* is rotatably driven by an actuator (not shown) in the form of a drive motor in order to pull the binding element 3 in its longitudinal direction backwards away from the sealing unit 20. The drive motor is configured to rotate the driven tensioning roller at low speed and high torque.

The drive motor is preferably an electric motor, but it could as an alternative be a hydraulic or pneumatic motor. The rotatably driven feeding roller and the rotatably driven tensioning roller may be driven by one and the same drive motor. As an alternative, the feeding and tensioning device 5 may comprise a first drive motor for rotating each rotatably driven feeding roller and a second drive motor for rotating each rotatably driven tensioning roller.

As an alternative to tensioning members in the form of tensioning rollers 5*c*, 5*d*, the feeding and tensioning device 5 may comprise tensioning members in the form of two clamping and pulling jaws for tensioning the binding element 3, wherein the clamping and pulling jaws are located opposite each other and configured to be moveable by an actuator, for instance in the form of a hydraulic cylinder, into gripping contact with opposite sides of a part of the binding element 3 received between them in order to establish a firm grip on the binding element. When the clamping and pulling jaws have been made to establish a firm grip on the binding element, they are together moved in the longitudinal direction of the binding element by an actuator, for instance in the form of a hydraulic cylinder, in order to exert a tensile force on the binding element.

Figure 2A:
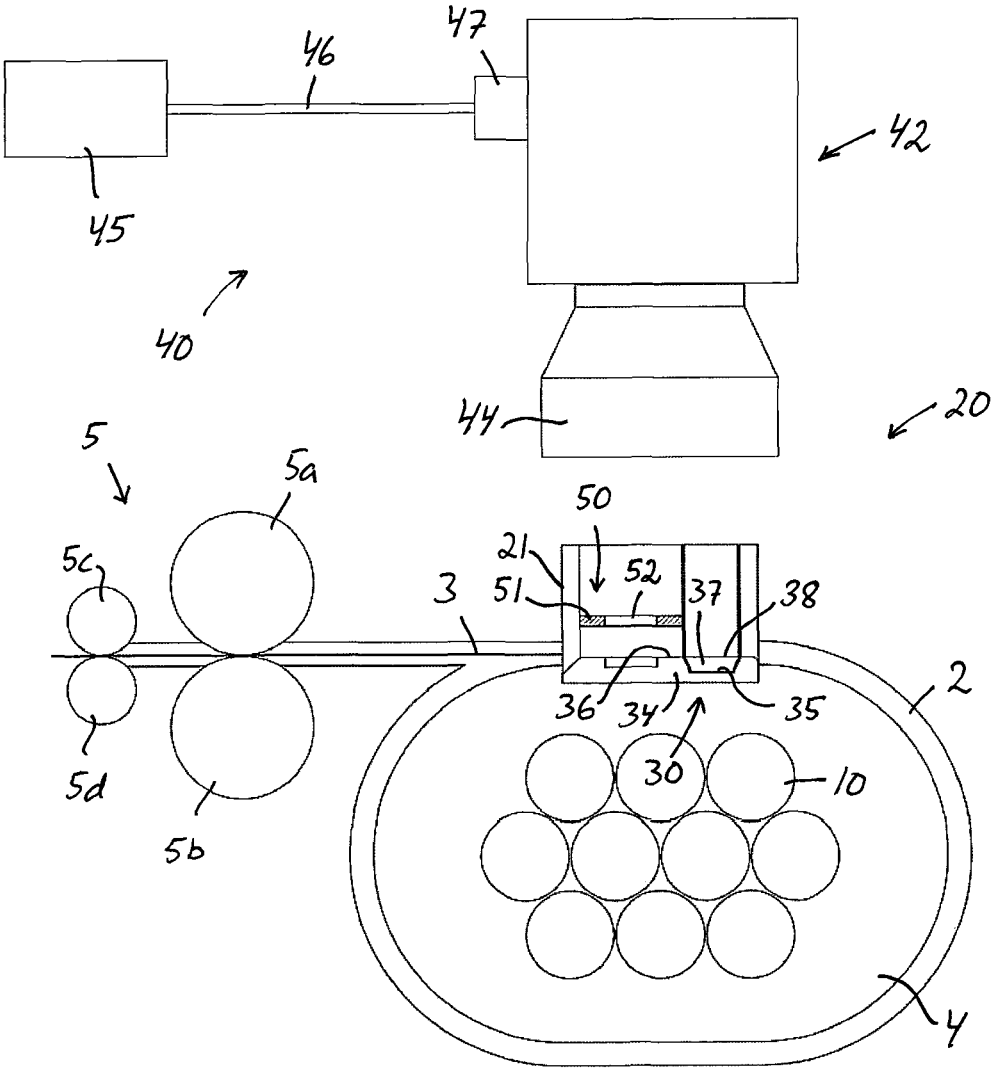
FIGS. 2*a*-2*j* are partly cut outline diagrams of parts included in the binding machine of FIG. 1, as seen at different stages during the process of securing a binding element in a loop around a bundle of objects and testing the strength of a joint formed on the binding element.
Figure 2H:
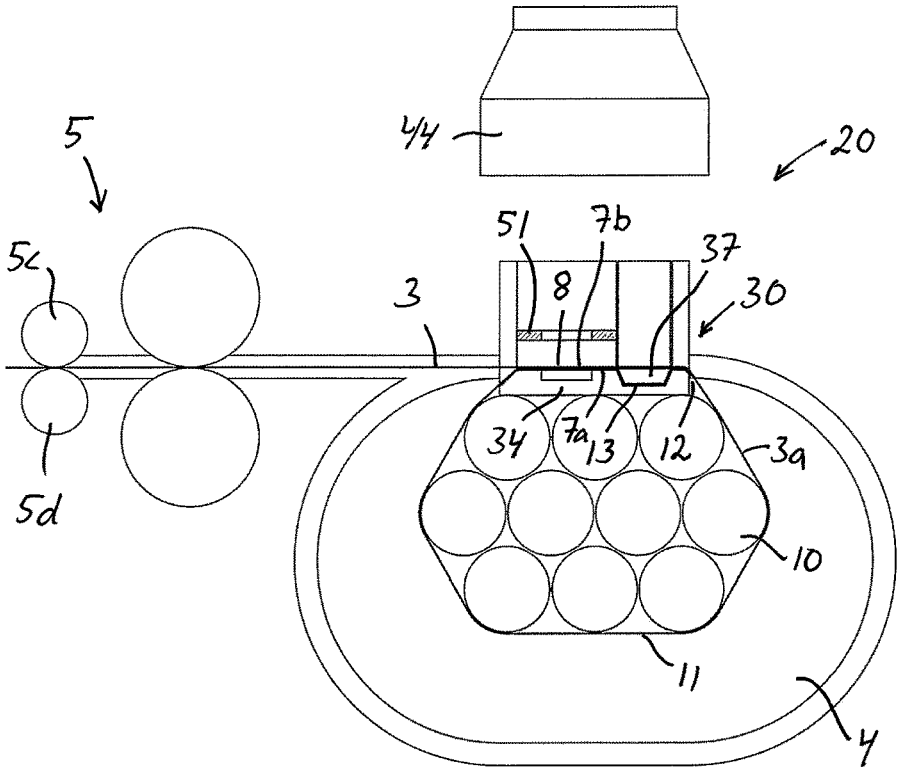
Figure 2I:
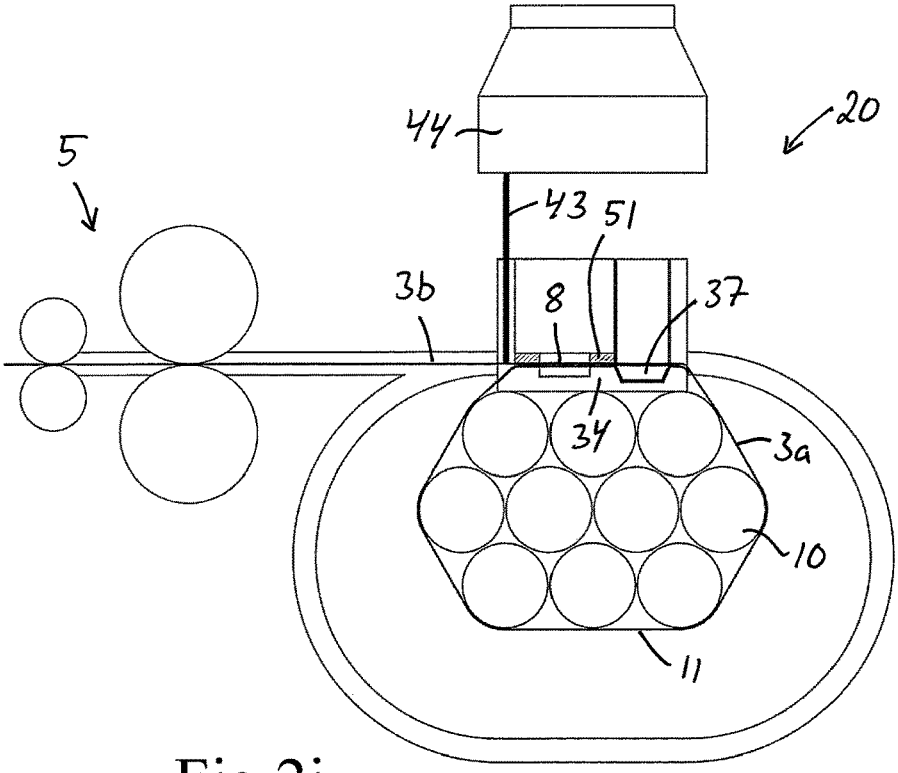
Figure 3A:
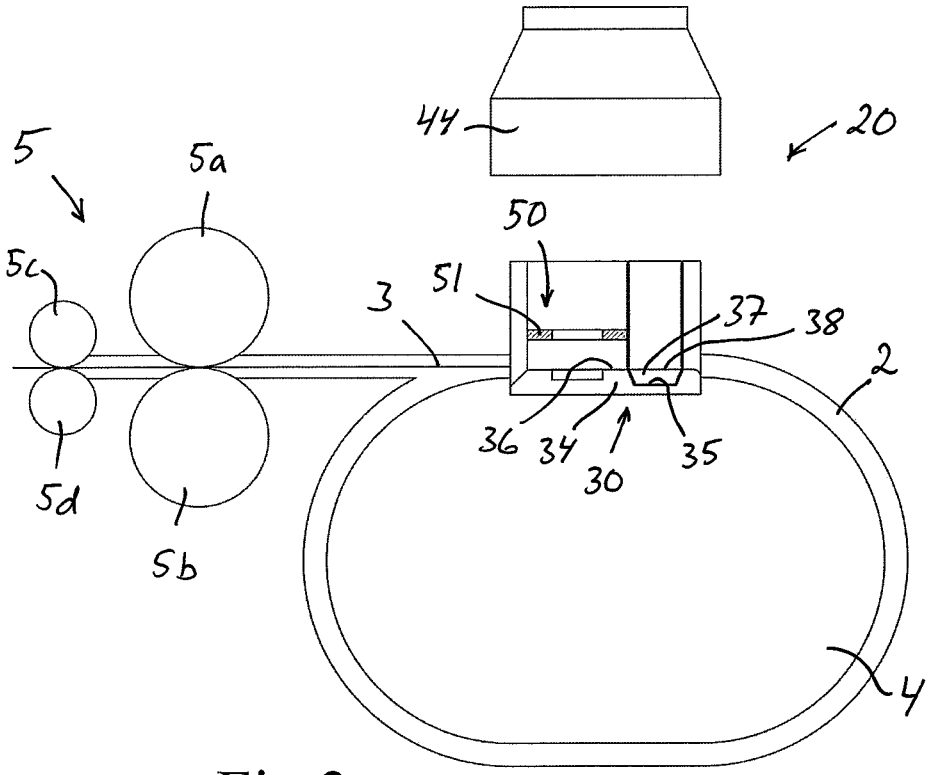
FIGS. 3*a*-3*e* are partly cut outline diagrams of parts included in the binding machine of FIG. 1, as seen at different stages during the process of forming a closed loop of a binding element and testing the strength of a joint formed on the binding element.
Figure 3B:
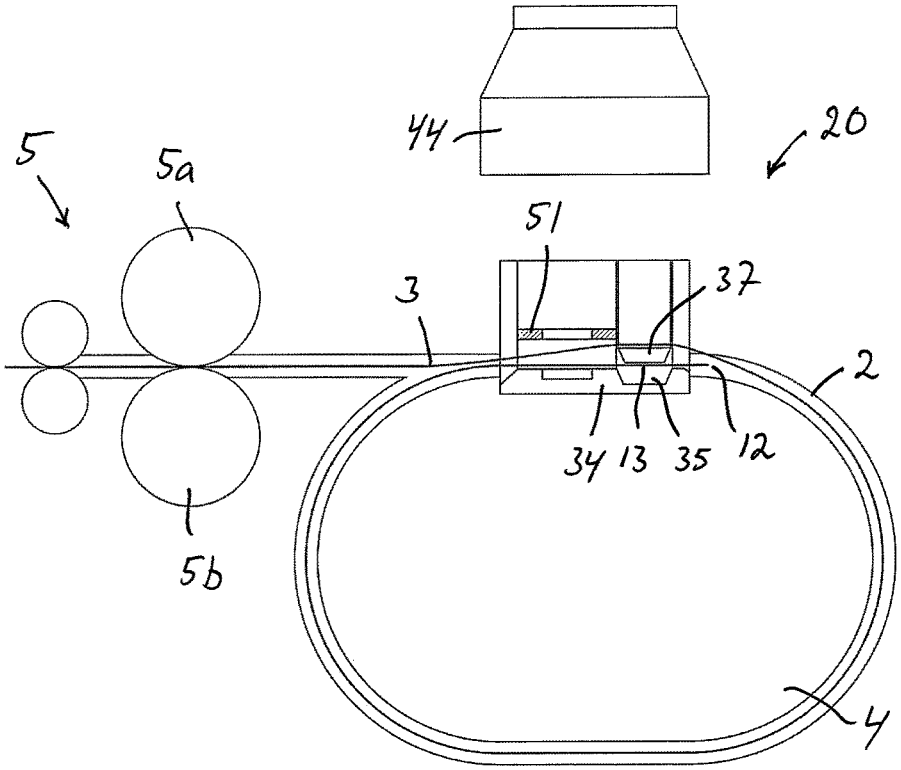

According to the invention, the feeding and tensioning device 5 is used in order to exert a tensile force on the binding element 3 after the formation of the above-mentioned joint 8 in order to subject the joint 8 to a tensile test and thereby check the strength of the joint 8. During this tensile test, the gripping arrangement 30 is configured to keep the first binding element section 7*a* secured in fixed position by engagement with a part 13 of the first binding element section located between the joint 8 and the leading end 12 of the binding element. The tensile test may be performed when a piece 3*a* of the binding element has been secured in a closed loop 11 around one or more objects 10 to be bound, as illustrated in FIG. 2*h*. As an alternative, the tensile test may be performed during a test procedure when a closed loop 11 of a piece 3*a* of the binding element has been formed in the object receiving space 4 without any object received inside the closed loop 11, i.e. with the closed loop 11 hanging freely below the gripping arrangement 30, as illustrated in FIG. 3*e*. The tensile tests may be performed at any desired intervals, for instance each time the use of a new supply coil 6 begins.

During the tensile test, the tensile force may be exerted on the binding element 3 under the effect of the tensioning members 5*c*, 5*d* included in the feeding and tensioning device 5 or under the combined effect of the feeding rollers 5*a*, 5*b* and the tensioning members 5*c*, 5*d*.

In the illustrated embodiment, the gripping arrangement 30 comprises a support member 34 for supporting the first and second binding element sections 7*a*, 7*b* during the formation of the welded joint 8. The support member 34 is configured to be located between the binding element sections 7*a*, 7*b* and an outer surface of the object or objects 10 to be bound during the formation of the welded joint 8. When the welded joint 8 has been formed, the support member 34 is moved laterally out of the area between the bounded object/objects 10 and the closed loop formed around the object/objects to thereby release the closed loop from the sealing unit 20.

In the illustrated embodiment, the gripping arrangement 30 also comprises a pressing element 37, which has a shape adapted to the shape of a recess 35 provided in an upper support surface 36 on the support member 34 so as to allow the pressing element 37 to be received in this recess 35. The pressing element 37 has an upper surface 38 which is flush or at least essentially flush with the upper support surface 36 on the support member 34 when the pressing element 37 is received in the recess 35 in the support member, as illustrated in FIGS. 2*a* and 3*a*.

Figure 4:
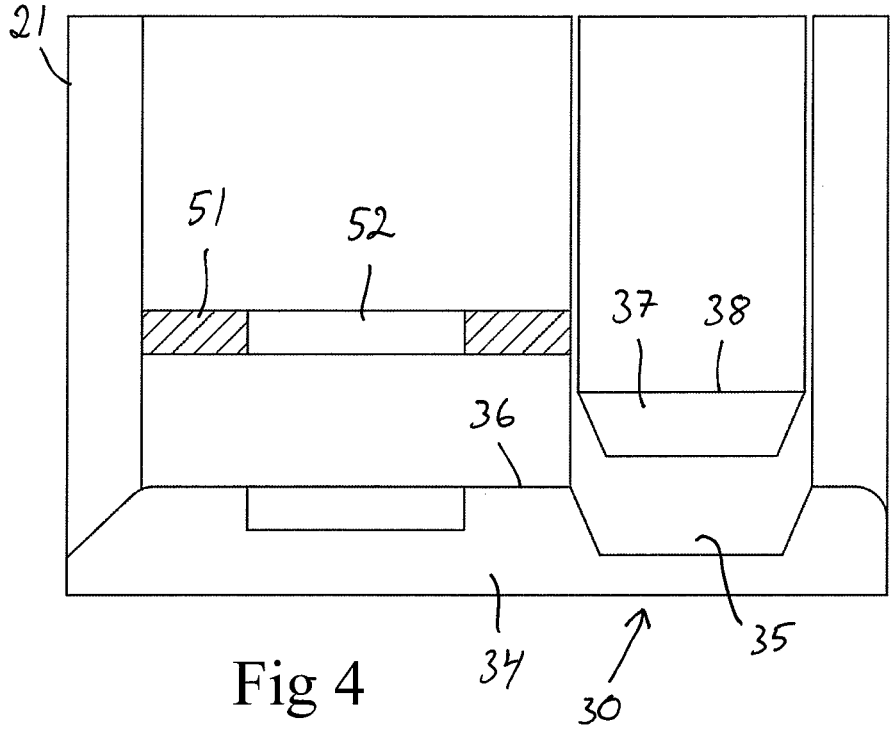
FIG. 4 is a schematic illustration of a support member and a pressing element included in the binding machine of FIG. 1, as seen with the pressing element in a retracted position at a distance from an associated recess in a support member.
Figure 5:
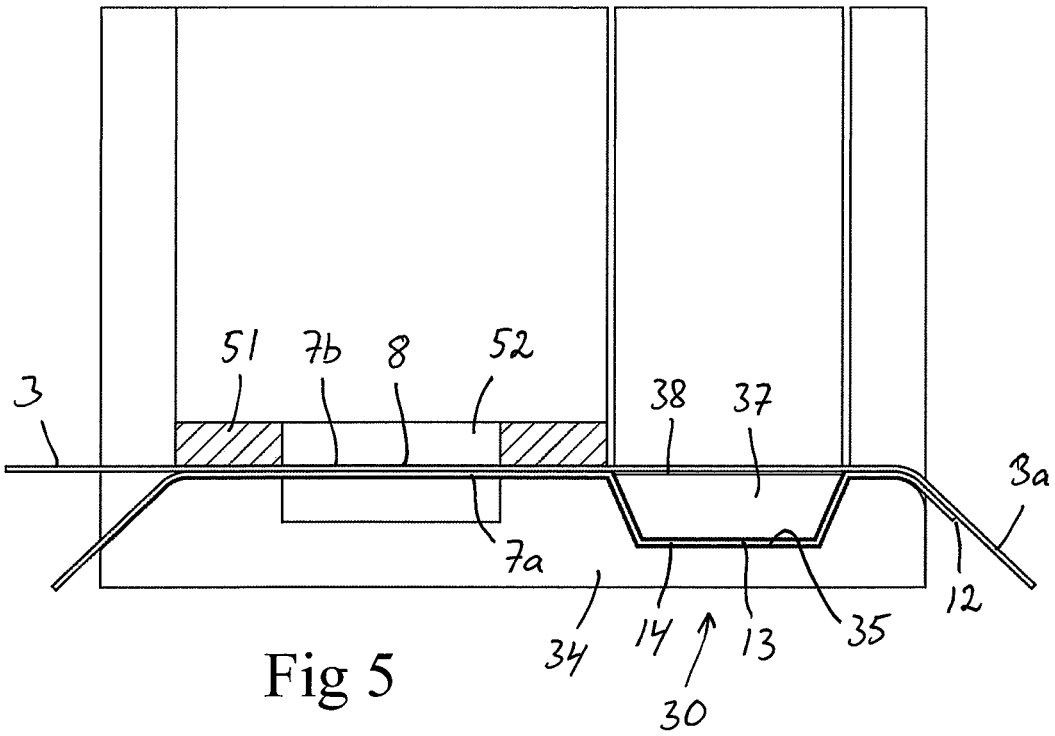
FIG. 5 is a schematic illustration of the support member and pressing element, as seen with the pressing element in an advanced position received in the recess in the support member.

An actuating device 39 (very schematically illustrated in FIG. 1) included in the gripping arrangement 30 is configured to move the pressing element 37 and the support member 34 in relation to each other between a first mutual position (see for instance FIGS. 2*c* and 4), in which the pressing element 37 is located outside and at a distance from the recess 35 in the support member 34, and a second mutual position (see for instance FIGS. 2*a* and 5), in which the pressing element 37 is received in said recess 35. The pressing element 37 and the support member 34 are configured to form a bulge 14 on the first binding element section 7*a* when the pressing element 37 and the support member 34 are moved in relation to each other by the actuating device 39 from said first mutual position to said second mutual position with a part 13 of the first binding element section 7*a* received in the space between the pressing element 37 and the support member 34, wherein this bulge 14 is formed at a position between the leading end 12 of the binding element 3 and the welded joint 8 to be formed by the joining device 40.

In the illustrated embodiment, the actuating device 39 is configured to achieve said relative movement between the pressing element 37 and the support member 34 by moving the pressing element 37 in relation to the support member 34. In this case, the pressing element 37 is moved downwards towards the support member 34 in order to achieve the movement from the first mutual position to the second mutual position and upwards away from the support member 34 in order to achieve the movement from the second mutual position to the first mutual position, wherein the support member 34 remains in a fixed position during the movements of the pressing element 37. As an alternative, the actuating device 39 may be configured to achieve said relative movement between the pressing element 37 and the support member 34 by moving the support member 34 in relation to the pressing element 37 or by moving the pressing element 37 as well as the support member 34 in relation to each other.

The pressing element 37 is also moveable horizontally by means of the actuating device 39 in order to allow the pressing element to be moved laterally out of the bulge 14 when the first and second binding element sections 7*a*, 7*b* have been secured to each other by the joining device 40 and the closed loop 11 thereby formed is to be released from the sealing unit 20. According to a first alternative, the pressing element 37 is formed as a single-part element and moveable out of the bulge 14 by a displacement in a horizontal direction. According to another alternative, the pressing element 37 is divided into two parts, which are located opposite each other and moveable out of the bulge 14 by being displaced laterally in opposite directions away from each other.

The support member 34 may comprise first and second support jaws located opposite each other in the manner shown in WO 2017/129679 A1, wherein the support jaws are moveable in relation to each other between an advanced supporting position, in which the support jaws form a support for the first binding element section 7*a*, and a retracted releasing position, in which the support jaws are retracted from each other in order to allow the first and second binding element sections 7*a*, 7*b*, after having been joined to each other, to pass through a gap between the support jaws. Each support jaw may be fixed to a pivot arm, which in its turn is pivotally mounted to a housing 21 of the sealing unit 20. Thus, in this case, the support jaws are pivotable between the supporting and releasing positions. As an alternative, the support jaws could be linearly moveable between the supporting and releasing positions. The support jaws are moveable between the supporting and releasing positions by means of the actuating device 39. As an alternative, the support member 34 is formed as a single-part member and moveable between the supporting and releasing positions by a displacement in a horizontal direction.

The actuating device 39 may be electrically, pneumatically or hydraulically driven and may comprise one or more electrically, pneumatically or hydraulically driven actuators.

In the illustrated example, the recess 35 and the pressing element 37 have a cross-sectional shape in the form of an isosceles trapezoid, as seen in a vertical plane. However, the recess 35 and the pressing element 37 may also have any other suitable cross-sectional shape.

The gripping arrangement 30 may of course also have any other suitable design in addition to the design illustrated in FIGS. 2*a*-2*j* and 3*a*-3*e*.

In the illustrated embodiment, the sealing unit 20 comprises a squeezing device 50 for squeezing the second binding element section 7*b* against the first binding element section 7*a* with the second binding element section 7*b* overlapping the first binding element section 7*a*, wherein the squeezing device 50 is configured to keep the second binding element section 7*b* squeezed against the first binding element section 7*a* during the moment when a welded joint 8 between the first and second binding element sections 7*a*, 7*b* is formed by the laser welding device 40. In the illustrated example, the squeezing device 50 comprises a squeezing member 51 which is configured to co-operate with the support member 34 and which is moveably mounted to the housing 21 of the sealing unit 20. The first and second binding element sections 7*a*, 7*b* are receivable in a space between the squeezing member 51 and the support member 34, and the squeezing member 51 is moveable in relation to the support member 34 between a retracted first position (see for instance FIGS. 2*a* and 4), in which the squeezing member 51 is retracted from the support member 34, and an advanced second position (see for instance FIGS. 2*g* and 5), in which the squeezing member 51 is pressed against the support member 34 in order to squeeze together the first and second binding element sections 7*a*, 7*b*. The squeezing member 51 is provided with a passage 52, through which a laser beam 43 from the laser welding head 42 of the laser welding device 40 may be directed towards an area on the second binding element section 7*b*, in order to form the welded joint 8 between the first and second binding element sections 7*a*, 7*b*, when the squeezing member 51 is in said second position and keeps the first and second binding element sections 7*a*, 7*b* squeezed together between the squeezing member 51 and the support member 34. The squeezing member 51 is moveable between said first and second positions by means of an actuator (not shown), which may be electrically, pneumatically or hydraulically driven. The actuator is with advantage a hydraulic cylinder.

The binding machine 1 further comprises an electronic control device 60 (very schematically illustrated in FIG. 1) for controlling the operation of the binding machine. The electronic control device 60 is connected to the feeding and tensioning device 5 and configured to control the actuator or actuators of the feeding rollers 5*a*, 5*b* and tensioning members 5*c*, 5*d*. The electronic control device 60 is also connected to the laser welding device 40 and configured to control the laser welding device to direct and focus the laser beam 43 of the laser welding device onto a desired part of the binding element 3. Furthermore, the electronic control device 60 is connected to the actuating device 39 of the gripping arrangement 30 and to the actuator of the squeezing device 50 and configured to control the operation thereof.

The electronic control device 60 may be implemented by one single electronic control unit or by two or more mutually co-operating electronic control units.

During the execution of a tensile test, the electronic control device 60 may be configured to make the feeding and tensioning device 5 exert a tensile force of a given magnitude on the binding element 3 to thereby subject the joint 8 to a tensile force of a given magnitude. If the joint 8 withstands this tensile force, the result of the tensile test is deemed to be positive and the binding of objects may continue. If the joint 8 does not withstand the tensile force exerted during the tensile test, the joint 8 will break and the result of the tensile test is deemed to be negative. A negative result of a tensile test may for instance be due to the use of a binding element of a material with inappropriate properties or due to inappropriate welding parameters. Before proceeding with a binding of objects after a negative tensile test, the cause thereof has to be analysed and taken care of.

As an alternative, the electronic control device 60 may, during the execution of a tensile test, be configured to make the feeding and tensioning device 5 exert a tensile force with a magnitude that is made to gradually increase until the joint 8 breaks. In this case, the tensile test will give a value of the maximum strength of the joint 8.

The electronic control device 60 may be configured to control the laser welding device 40 to direct a laser beam 43 (see FIG. 2*i*) onto an area at the trailing end of the second binding element section 7*b*, i.e. at the end of the second binding element section 7*b* facing the feeding and tensioning device 5, in order to cause the binding element to be broken or cut off at the trailing end of the second binding element section 7*b*. Hereby, the closed loop 11 arranged around the object or objects 10 to be bound is released from the remaining part 3*b* of the binding element. When the joint 8 is to be subjected to a tensile test under the effect of the feeding and tensioning device 5, the release of the closed loop 11 from the remaining part 3*b* of the binding element is of course effected after the performance of the tensile test.

The laser welding head 42 may comprise one or more computer-controlled scanning mirrors for controlling the direction and movement of the laser beam 43 emitted from the laser welding head. As an alternative, the direction and movement of the laser beam 43 may be controlled by computer-controlled movements of the entire laser welding head 42. The laser welding head 42 is provided with a focusing lens 44, through which the laser beam 43 leaves the laser welding head.

In the illustrated embodiment, the laser welding device 40 further comprises a laser source 45 (see FIG. 2*a*) for generating the laser power required for producing the laser beam 43 used for forming the welded joint 8 between the first and second binding element sections 7*a*, 7*b* and for releasing the closed loop 11 from the remaining part 3*b* of the binding element. The laser source 45 can be of any type commonly used for welding. In the illustrated example, the laser source 45 is connected to the laser welding head 42 via an optical fibre cable 46, which is configured to guide the laser power generated by the laser source 45 to the laser welding head 42. The optical fibre cable 46 is in a conventional manner connected to the laser welding head 42 by means of an optical connector 47 comprising focusing optics. The focal point of the laser beam 43 emitted from the laser welding head 42 may be adjusted by computer-controlled movements of one or more optical members included in the focusing optics of the optical connector 47.

An operating sequence for securing a binding element 3 in the form of a strap in a loop around a bundle of objects 10 and performing a tensile test by means of the above-described binding machine 1 will now be described with reference to FIGS. 2*a*-2*j*.

In a first step, the drive motor of the feeding rollers 5*a*, 5*b* is operated in a first direction in order to feed the binding element 3 forwards from the supply coil 6, through the sealing unit 20, in a loop around the object receiving space 4 of the binding machine 1 and then back into the sealing unit 20. The leading end 12 of the binding element is first moved over the support member 34 and the pressing element 37, thereafter in a loop around the object receiving space 4 and then into a space between the pressing element 37 and the recess 35 in the support surface 36 on the support member 34, wherein the feeding of the binding element 3 is stopped when the leading end 12 of the binding element has reached a given end position.

During the feeding of the binding element 3, the squeezing member 51 is in its retracted first position.

Figure 2B:
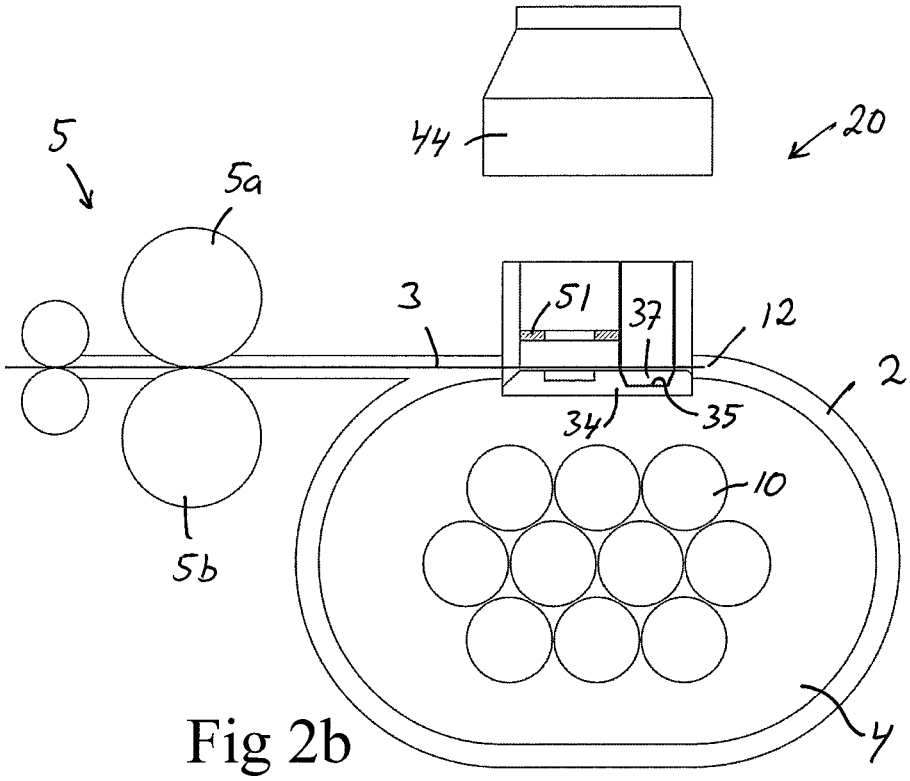
Figure 2C:
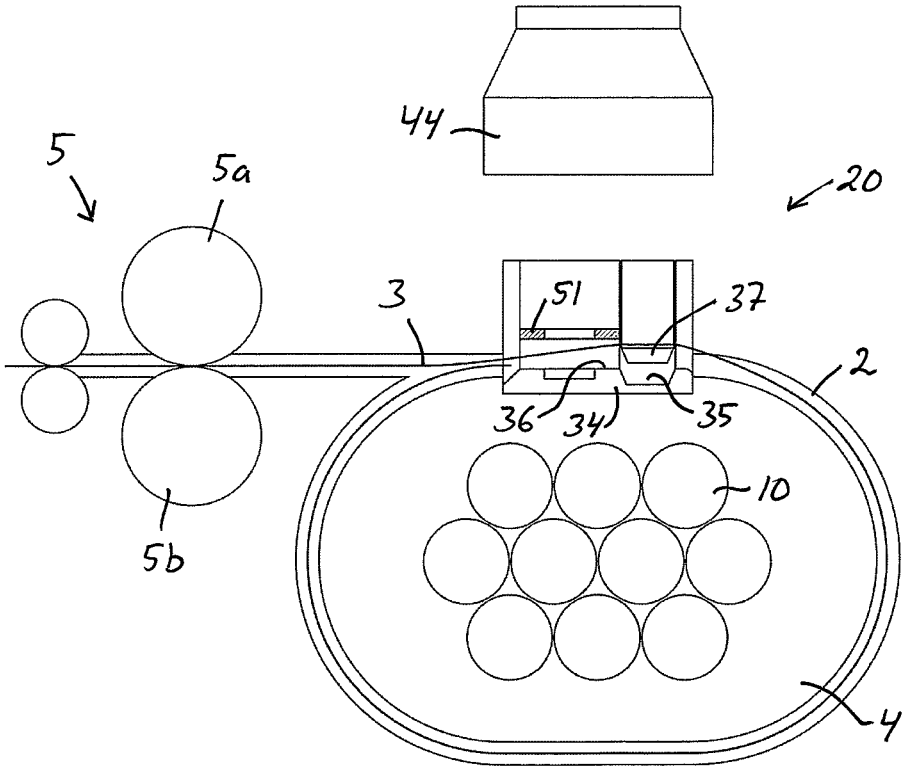
Figure 2D:
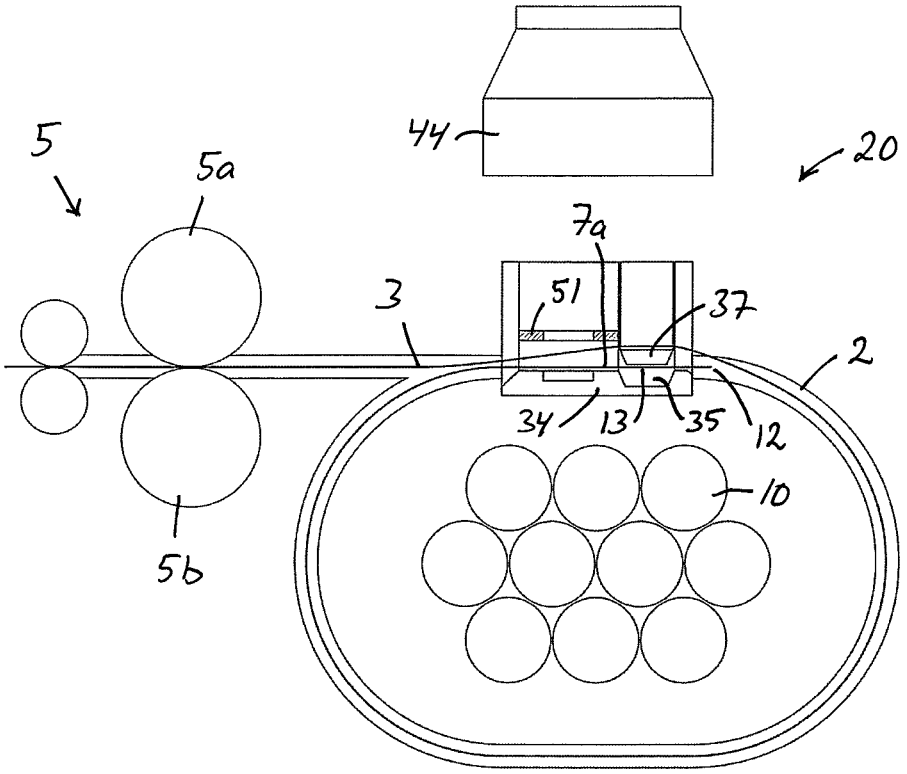

In the illustrated example, the pressing element 37 is positioned in the recess 35 in the support member 34 before the initial feeding of the leading end 12 of the binding element through the sealing unit 20 and maintained in the recess 35 until the leading end 12 of the binding element has passed over the upper surface 38 of the pressing element 37 and the upper support surface 36 on the support member 34, as illustrated in FIGS. 2*a* and 2*b*. Thus, in this case the upper surface 38 of the pressing element 37 is flush or at least essentially flush with the upper support surface 36 on the support member 34 when the leading end 12 of the binding element is fed through the sealing unit 20 before being fed around the object receiving space 4. The actuating device 39 thereafter effects a relative movement between the pressing element 37 and the support member 34 in order to cause the pressing element 37 to be positioned at a distance from the recess 35 in the support member 34, wherein the binding element 3 is lifted by the pressing element 37 from the upper support surface 36 on the support member 34, as illustrated in FIG. 2*c*.

Figure 2E:
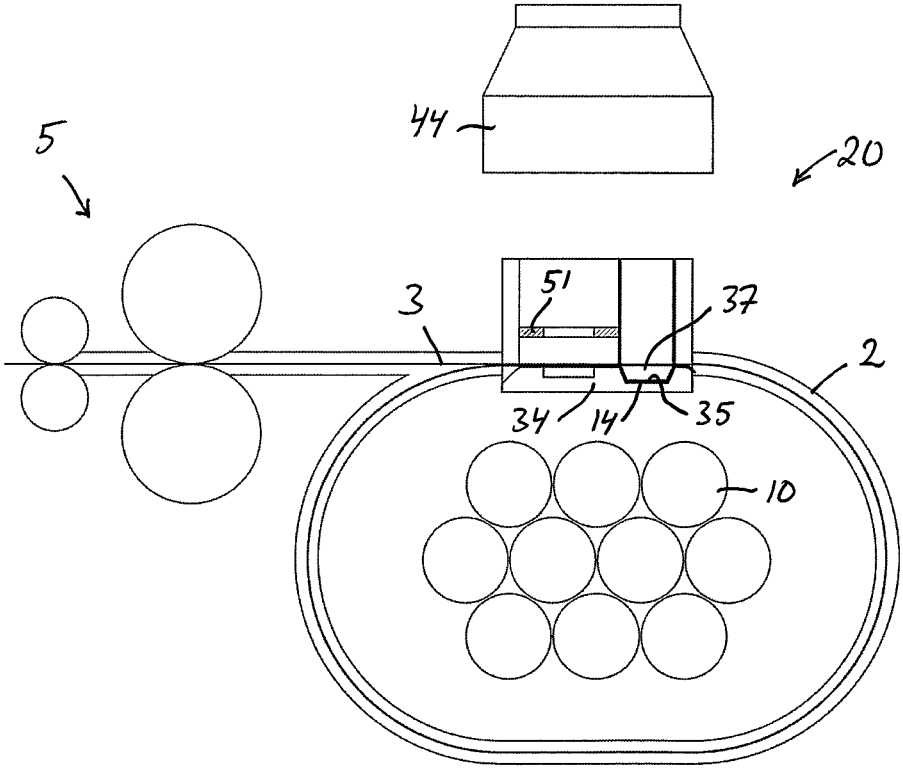
Figure 2F:
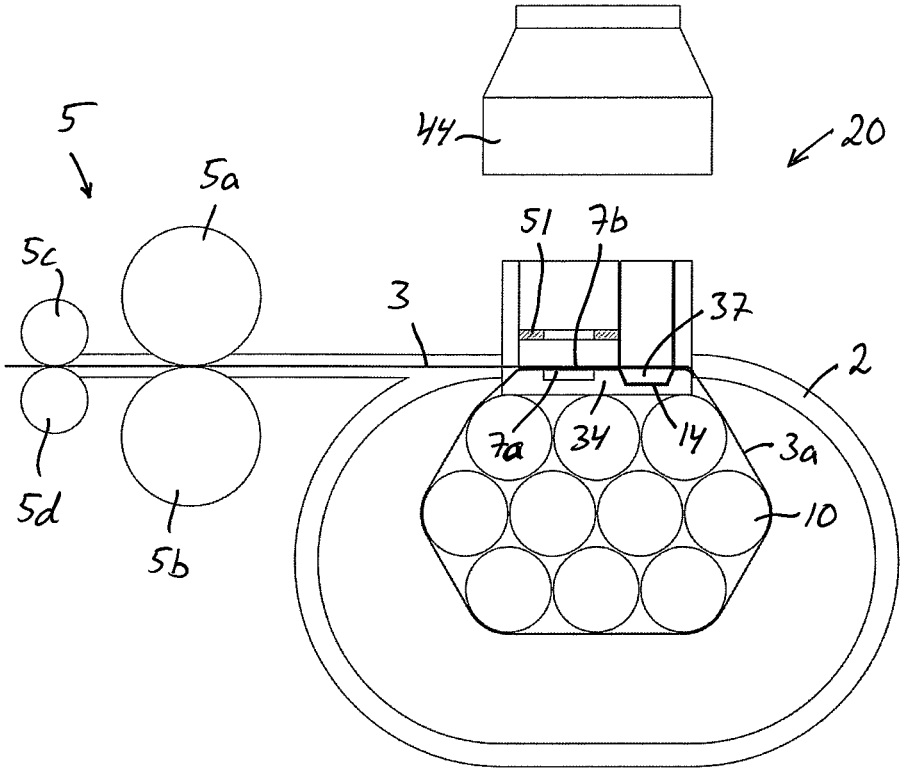

When the binding element 3 has been fed through the guide track 2 in a loop around the object receiving space 4, the leading end 12 of the binding element 3 will leave the guide track 2 and pass through the gap between the pressing element 37 and the support member 34 (see FIG. 2*d*), whereupon the leading end 12 of the binding element 3 actuates a stop member (not shown) and the drive motor of the feeding rollers 5*a*, 5*b* is stopped. The actuating device 39 thereafter effects a relative movement between the pressing element 37 and the support member 34 in order to cause the pressing element 37 to be received in the recess 35 (see FIG. 2*e*) and thereby effect gripping and locking of the first binding element section 7*a* at the leading end of the binding element 3 while forming a bulge 14 on the first binding element section 7*a*. In the next step, the drive motor of the feeding rollers 5*a*, 5*b* is reversed in order to retract the binding element 3 and thereby pull the binding element 3 out of the guide track 2 and into contact with the objects 10 received in the object receiving space 4, as illustrated in FIG. 2*f*. Thereafter, the drive motor of the tensioning rollers 5*c*, 5*d* is operated in order to draw the binding element 3 more tightly around the objects 10. As illustrated in FIGS. 2*e* and 2*f*, the sealing unit 20 and the guide track 2 are moveable in relation to the objects 10 and configured to move towards the objects 10 when the binding element 3 is tightened around the objects.

Figure 2G:
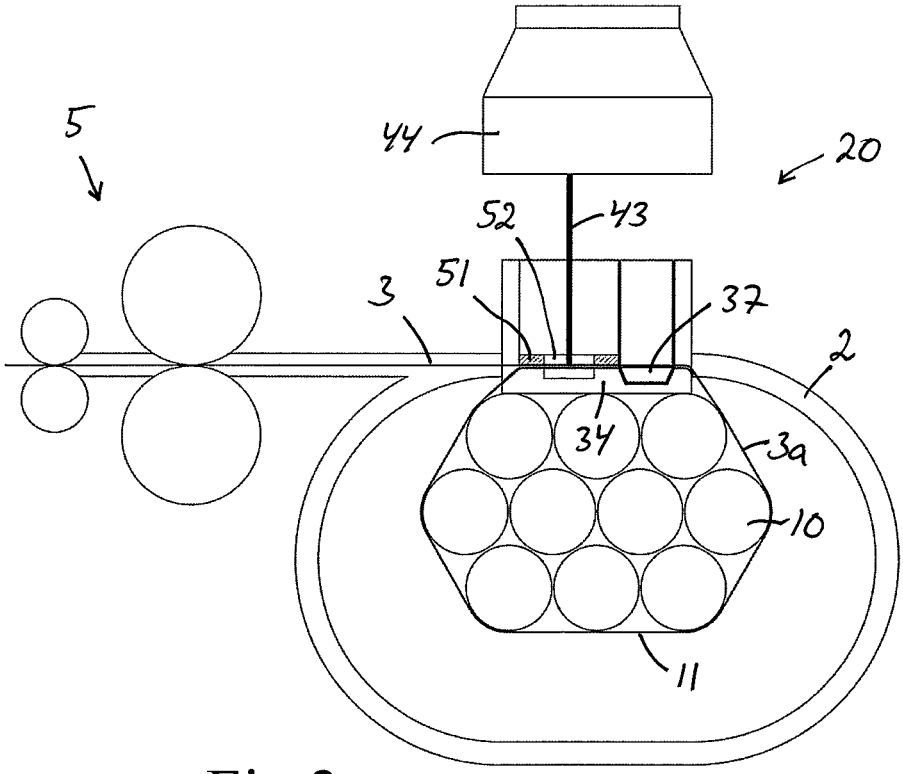

When the binding element 3 has been drawn tightly around the objects 10, the squeezing member 51 is moved to its advanced second position in order to squeeze together the first and second binding element sections 7*a*, 7*b* between the squeezing member 51 and the support member 34 (see FIG. 2*g*). The laser welding device 40 is then operated to focus a laser beam 43 onto the mutually overlapping binding element sections 7*a*, 7*b* in order to form a welded joint 8 between the binding element sections 7*a*, 7*b*. A piece 3*a* of the binding element 3 is thereby secured in a closed loop 11 around the objects 10.

In the next step, the squeezing member 51 is moved to its retracted first position, as illustrated in FIG. 2*h*, whereupon the drive motor of the tensioning rollers 5*c*, 5*d* is operated so as to make the tensioning rollers 5*c*, 5*d* exert a tensile force of a given magnitude on the binding element 3 in order to subject the joint 8 to a tensile test and thereby check the strength of the joint 8. During this tensile test, the pressing element 37 is maintained in the recess 35 in the support member 34 and the gripping arrangement 30 thereby keeps the first binding element section 7*a* secured in fixed position in the sealing unit 20 by engagement with the part 13 of the first binding element section located between the joint 8 and the leading end 12 of the binding element.

Figure 2J:
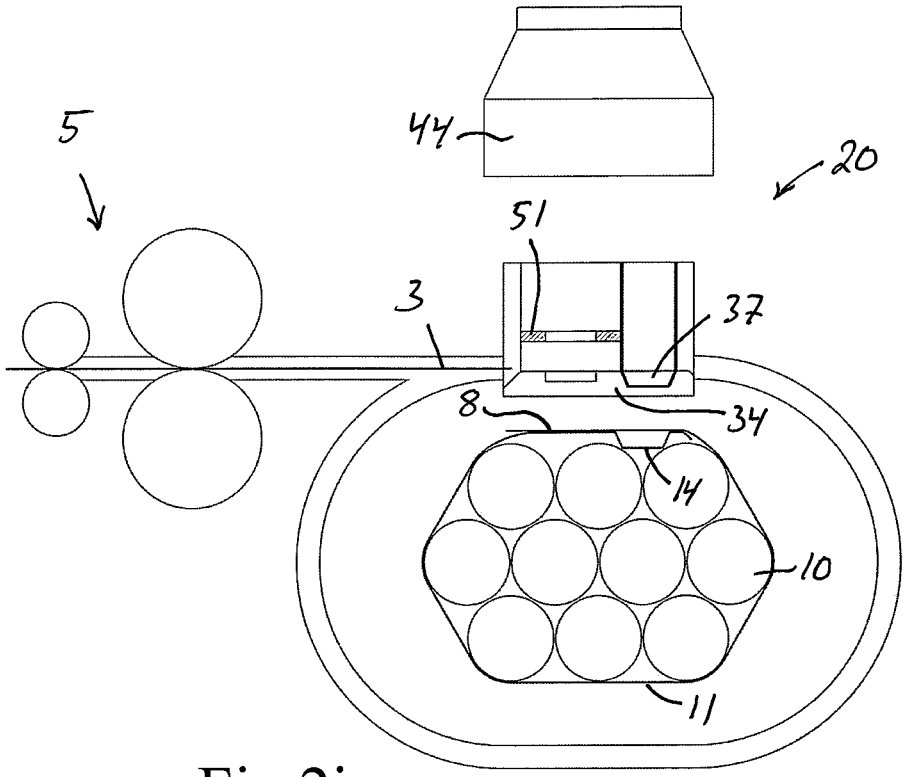

If the joint 8 withstands the tensile test, the squeezing member 51 is in the next step (see FIG. 2*i*) moved back to its advanced second position, whereupon the laser welding device 40 is operated to direct a laser beam 43 onto an area at the trailing end of the second binding element section 7*b* in order to break or cut off the binding element 3 at the trailing end of the second binding element section 7*b* and thereby release the closed loop 11 around the objects 10 from the remaining part 3*b* of the binding element. Finally, the squeezing member 51 is returned to its retracted first position and the pressing element 37 and support member 34 are removed from the first binding element section 7*a* in order to release the closed loop 11 from the sealing unit 20, as illustrated in FIG. 2*j*.

Figure 3C:
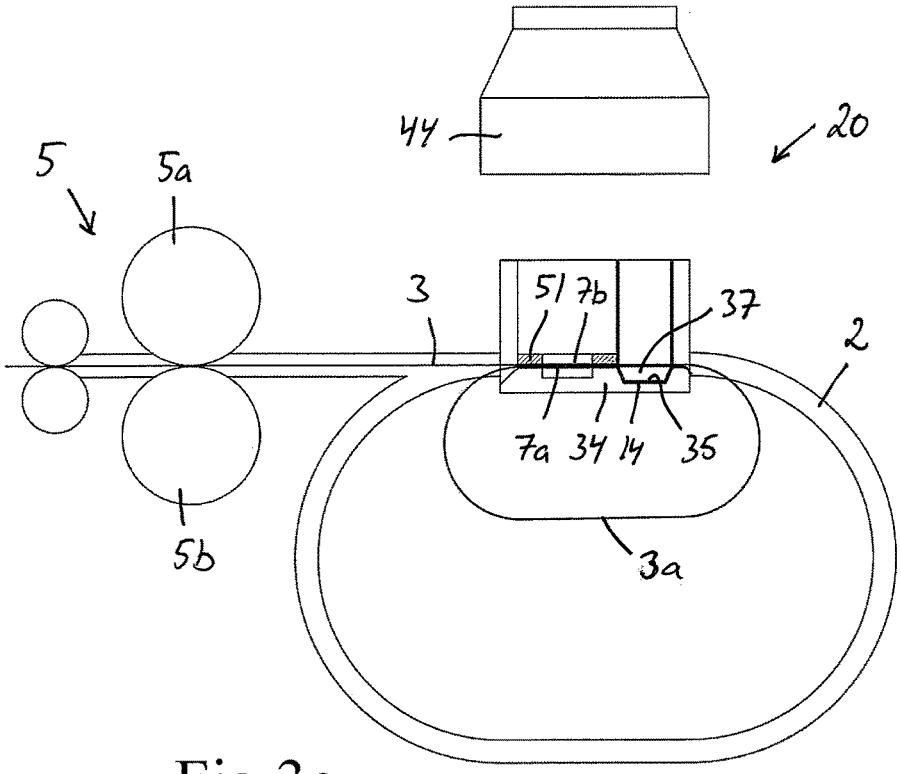
Figure 3D:
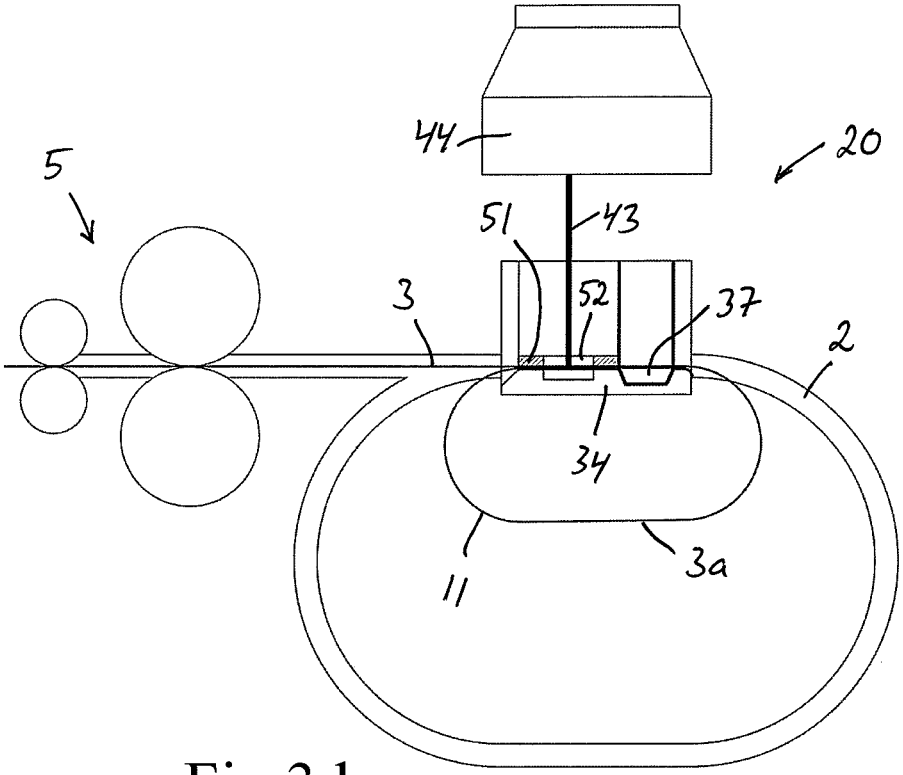
Figure 3E:
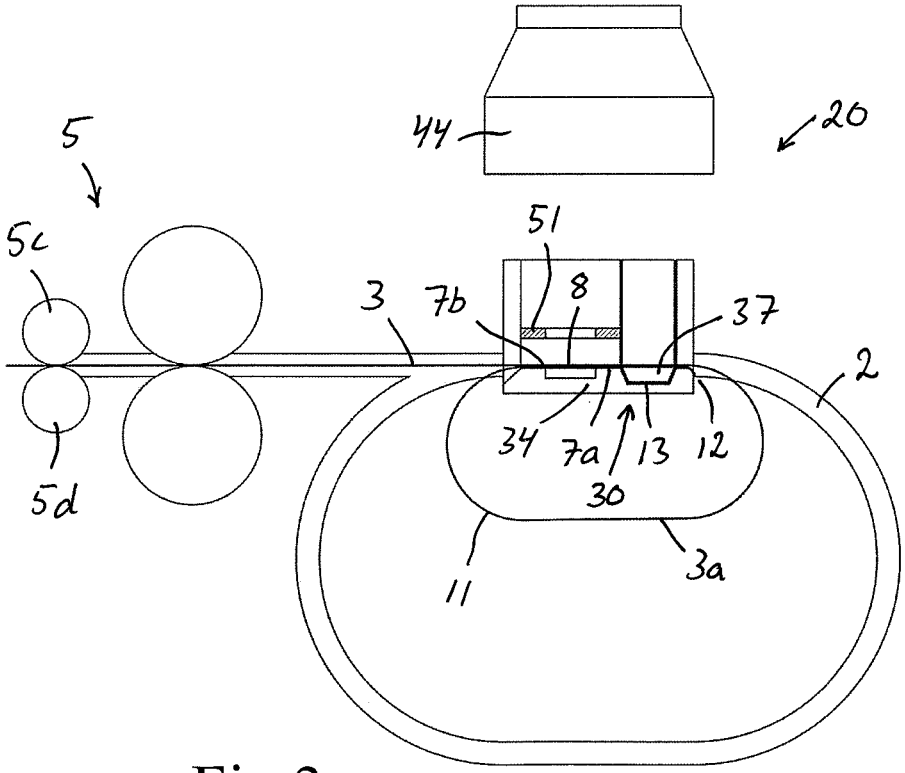

FIGS. 3*a*-3*e* illustrate an alternative operating sequence for forming a closed loop 11 of a binding element 3 in the form of a strap and performing a tensile test by means of the above-described binding machine 1. In this case, the tensile test is performed during a separate test procedure without having the closed loop 11 secured around any object to be bound. At first, the binding element 3 is feed forwards by the feeding rollers 5*a*, 5*b*, and the first binding element section 7*a* at the leading end of the binding element is gripped by the gripping arrangement 30 in the manner described above with reference to FIGS. 2*a*-2*e*. In the next step, the drive motor of the feeding rollers 5*a*, 5*b* is reversed in order to retract the binding element 3 and thereby pull the binding element 3 out of the guide track 2, as illustrated in FIG. 3*c*. Thereafter, the squeezing member 51 is moved to its advanced second position in order to squeeze together the first and second binding element sections 7*a*, 7*b* between the squeezing member 51 and the support member 34. The laser welding device 40 is then operated to focus a laser beam 43 onto the mutually overlapping binding element sections 7*a*, 7*b* in order to form a welded joint 8 between the binding element sections 7*a*, 7*b*. A closed binding element loop 11 is hereby formed in the object receiving space 4. In the next step, the squeezing member 51 is moved to its retracted first position, as illustrated in FIG. 3*e*, whereupon the drive motor of the tensioning rollers 5*c*, 5*d* is operated so as to make the tensioning rollers 5*c*, 5*d* exert a tensile force of a given magnitude on the binding element 3 in order to subject the joint 8 to a tensile test and thereby check the strength of the joint 8. During this tensile test, the pressing element 37 is maintained in the recess 35 in the support member 34 and the gripping arrangement 30 thereby keeps the first binding element section 7*a* secured in fixed position in the sealing unit 20 by engagement with the part 13 of the first binding element section located between the joint 8 and the leading end 12 of the binding element.

The invention is of course not in any way restricted to the embodiments described above. On the contrary, many possibilities to modifications thereof will be apparent to a person with ordinary skill in the art without departing from the basic idea of the invention such as defined in the appended claims. The binding machine according to the present invention may for instance be design for co-operation with a compacting machine in order to bind a coil of wire compacted by the compacting machine. In the latter case, several sealing units are mounted to the compacting machine and used simultaneously in order to apply binding element loops at different positions around the compacted coil of wire, wherein each binding element loop extends along the inside of the coil through a central axial opening therein and along the outside of the coil.

The invention claimed is:

1. A binding machine comprising:

a feeding and tensioning device (5) for feeding an elongated binding element (3) in the form of a wire or strap in a loop around a space (4) configured for receiving one or more objects (10) to be bound and subsequently retracting the binding element (3) to draw it tightly around the one or more objects (10) received in said space (4);

a gripping arrangement (30) for gripping and locking a first binding element section (7*a*) at the a leading end of the binding element (3) after the feeding of the binding element in a loop around said space (4);

a joining device (40) for forming a joint (8) between said first binding element section (7*a*) and an adjoining second binding element section (7*b*) at a trailing end of a piece (3*a*) of the binding element arranged in a loop in or around said space (4) to thereby form a closed loop (11) of this piece (3*a*) of the binding element; and an electronic control device (60), wherein the electronic control device (60) is configured to control the feeding and tensioning device (5) to exert a tensile force on the binding element (3) after the formation of said joint (8) to subject the joint (8) to a tensile test and thereby check a strength of the joint (8); and wherein during said tensile test, the gripping arrangement (30) is configured to keep the first binding element section (7*a*) secured in a fixed position by engagement of the gripping arrangement (30) with a part (13) of the first binding element section (7*a*) located between said joint (8) and the leading end (12) of the binding element.

2. The binding machine according to claim 1, wherein the joining device (40) is a welding device.

3. The binding machine according to claim 2, wherein the welding device is a laser welding device.

4. The binding machine according to claim 1, wherein the gripping arrangement (30) comprises a support member (34) for supporting said first and second binding element sections (7*a*, 7*b*) during the formation of the joint (8).

5. The binding machine according to claim 4, wherein a recess (35) is provided in an upper support surface (36) of the support member (34);

the gripping arrangement (30) comprises a pressing element (37), which has a shape adapted to the shape of the recess (35) in the support member (34) to allow the pressing element (37) to be received in the recess (35);

the gripping arrangement (30) comprises an actuating device (39) which is configured to move the pressing element (37) and the support member (34) in relation to each other between a first mutual position, in which the pressing element (37) is positioned at a distance from the recess (35) in the support member (34), and a second mutual position, in which the pressing element (37) is received in said recess (35); and the pressing element (37) and the support member (34) are configured to form a bulge (14) on said part (13) of the first binding element section (7*a*) when the pressing element (37) and the support member (34) are moved in relation to each other by the actuating device (39) from said first mutual position to said second mutual position with said part (13) of the first binding element section received in a space between the pressing element (37) and the support member (34).

6. The binding machine according to claim 5, wherein the actuating device (39) is configured to achieve said relative movement between the pressing element (37) and the support member (34) by moving the pressing element (37) in relation to the support member (34).

7. The binding machine according to claim 5, wherein the actuating device (39) is configured to achieve said relative movement between the pressing element (37) and the support member (34) by moving the support member (34) in relation to the pressing element (37).

8. The binding machine according to claim 5, wherein that the pressing element (37) has an upper surface (38) which is flush or at least essentially flush with the upper support surface (36) of the support member (34) when the pressing element (37) is received in said recess (35).

9. The binding machine according to claim 4, wherein the binding machine (1) comprises a squeezing device (50) for squeezing the second binding element section (7*b*) against the first binding element section (7*a*) with the second binding element section (7*b*) overlapping the first binding element section (7*a*), the squeezing device (50) comprising a squeezing member (51) which is configured to co-operate with the support member (34);

the first and second binding element sections (7*a*, 7*b*) are receivable in a space between the squeezing member (51) and the support member (34);

the squeezing member (51) is moveable in relation to the support member (34) between a retracted first position, in which the squeezing member (51) is retracted from the support member (34), and an advanced second position, in which the squeezing member (51) is pressed against the support member (34) in order to squeeze together the first and second binding element sections (7*a*, 7*b*); and the electronic control device (60) is configured to control the squeezing device (50) to keep the squeezing member (51) in said first position during a moment when the joint (8) between the first and second binding element sections (7*a*, /b) is formed by the joining device (40) and to keep the squeezing member (51) in said second position during an execution of the tensile test.

10. The binding machine according to claim 1, wherein the binding machine (1) is a strapping machine.

11. The binding machine according to claim 1, wherein the feeding and tensioning device (5) comprises feeding rollers (5*a*, 5*b*) for feeding and retracting the binding element (3), and tensioning members (5*c*, 5*d*) for tensioning the binding element (3) and exerting said tensile force on the binding element.

12. The binding machine according to claim 2, wherein the gripping arrangement (30) comprises a support member (34) for supporting said first and second binding element sections (7*a*, 7*b*) during the formation of the joint (8).

13. The binding machine according to claim 3, wherein the gripping arrangement (30) comprises a support member (34) for supporting said first and second binding element sections (7*a*, 7*b*) during the formation of the joint (8).

14. The binding machine according to claim 13, wherein a recess (35) is provided in an upper support surface (36) of the support member (34);

the gripping arrangement (30) comprises a pressing element (37), which has a shape adapted to the shape of the recess (35) in the support member (34) to allow the pressing element (37) to be received in the recess (35);

the gripping arrangement (30) comprises an actuating device (39) which is configured to move the pressing element (37) and the support member (34) in relation to each other between a first mutual position, in which the pressing element (37) is positioned at a distance from the recess (35) in the support member (34), and a second mutual position, in which the pressing element (37) is received in said recess (35); and the pressing element (37) and the support member (34) are configured to form a bulge (14) on said part (13) of the first binding element section (7*a*) when the pressing element (37) and the support member (34) are moved in relation to each other by the actuating device (39) from said first mutual position to said second mutual position with said part (13) of the first binding element section received in a space between the pressing element (37) and the support member (34).

15. The binding machine according to claim 12, wherein a recess (35) is provided in an upper support surface (36) of the support member (34);

the gripping arrangement (30) comprises a pressing element (37), which has a shape adapted to the shape of the recess (35) in the support member (34) to allow the pressing element (37) to be received in the recess (35);

the gripping arrangement (30) comprises an actuating device (39) which is configured to move the pressing element (37) and the support member (34) in relation to each other between a first mutual position, in which the pressing element (37) is positioned at a distance from the recess (35) in the support member (34), and a second mutual position, in which the pressing element (37) is received in said recess (35); and the pressing element (37) and the support member (34) are configured to form a bulge (14) on said part (13) of the first binding element section (7*a*) when the pressing element (37) and the support member (34) are moved in relation to each other by the actuating device (39) from said first mutual position to said second mutual position with said part (13) of the first binding element section received in a space between the pressing element (37) and the support member (34).

16. The binding machine according to claim 15, wherein the actuating device (39) is configured to achieve said relative movement between the pressing element (37) and the support member (34) by moving the pressing element (37) in relation to the support member (34).

17. A method for forming a closed loop (11) of an elongated binding element (3) in the form of a wire or strap by a binding machine (1) and testing a strength of a joint (8) formed on said closed loop (11), the method comprising the steps of:

feeding the binding element (3), by a feeding and tensioning device (5) included in the binding machine (1), in a loop around a space (4) configured for receiving one or more objects (10) to be bound;

gripping and locking, by a gripping arrangement (30) included in the binding machine (1), a first binding element section (7*a*) at a leading end of the binding element (3) after the feeding of the binding element in a loop around said space (4);

forming, by a joining device (40) included in the binding machine (1), a joint (8) between said first binding element section (7*a*) and an adjoining second binding element section (7*b*) at a trailing end of a piece (3*a*) of the binding element arranged in a loop in or around said space (4) to thereby form a closed loop (11) of said piece (3*a*) of the binding element; and exerting a tensile force on the binding element (3) by the feeding and tensioning device (5) after the formation of said joint (8) to subject the joint (8) to a tensile test and thereby check a strength of the joint (8), wherein the gripping arrangement (30) during said tensile test keeps the first binding element section (7*a*) secured in fixed position by engagement of the gripping arrangement (30) with a part (13) of the first binding element section (7*a*) located between said joint (8) and the leading end (12) of the binding element.

18. The method according to claim 17, wherein said joining device (40) is a welding device.

19. The method according to claim 17, wherein said first and second binding element sections (7*a*, 7*b*) are supported by a support member (34) of the gripping arrangement (30) during the formation of the joint (8) and during an execution of the tensile test;

the first and second binding element sections (7*a*, 7*b*) are received in a space between the support member (34) and a squeezing member (51) with the second binding element section (7*b*) overlapping the first binding element section (7*a*);

the squeezing member (51) is pressed against the support member (34) to squeeze together the first and second binding element sections (7*a*, 7*b*) during the formation of the joint (8); and the squeezing member (51) is retracted from the support member (34) after the formation of the joint (8) and kept in a non-squeezing position at a distance from the support member (34) during the execution of the tensile test.

20. The method according to claim 18, wherein said welding device is a laser welding device.

* * * * *